US007530241B2

(12) United States Patent
Shih

(10) Patent No.: US 7,530,241 B2
(45) Date of Patent: May 12, 2009

(54) METHOD FOR KNITTING DENIM

(75) Inventor: Larry Shih, Taipei (TW)

(73) Assignee: Dabus Co., Ltd., Taipei (TW)

( * ) Notice: Subject to any disclaimer, the term of this patent is extended or adjusted under 35 U.S.C. 154(b) by 549 days.

(21) Appl. No.: 11/257,916

(22) Filed: Oct. 24, 2005

(65) Prior Publication Data

US 2006/0075579 A1 Apr. 13, 2006

(51) Int. Cl.
*D04B 1/00* (2006.01)
*D04B 21/00* (2006.01)
*D04B 21/12* (2006.01)

(52) U.S. Cl. ..... 66/147; 66/171; 66/196; 8/115.6; 8/116.1; 8/151.2; 8/494; 8/495; 8/497; 8/636

(58) Field of Classification Search ..... 8/115.51, 8/494, 115.6, 116.1, 151.2, 495, 497, 636; 66/146, 147, 171, 176
See application file for complete search history.

(56) References Cited

U.S. PATENT DOCUMENTS 3,828,585 A * 8/1974 Thorneburg ..... 66/136
4,613,336 A * 9/1986 Quinnen ..... 8/494
4,951,366 A * 8/1990 Geller ..... 26/28
5,870,807 A * 2/1999 Beaty et al. ..... 28/167

FOREIGN PATENT DOCUMENTS

| | | |
|---|---|---|
| JP | 54-82493 | 6/1979 |
| JP | 06-093543 | 4/1994 |
| JP | 09-501205 | 2/1997 |
| JP | 09-188901 | 7/1997 |
| JP | 2003-301350 | 10/2003 |
| WO | 95/04850 | 2/1995 |

* cited by examiner

*Primary Examiner*—Lorna M Douyon
*Assistant Examiner*—Amina Khan
(74) *Attorney, Agent, or Firm*—patenttm.us

(57) ABSTRACT

A method for knitting denim comprising: dyeing yarn with a dyestuff to obtain dyed-yarn; knitting the dyed-yarn into a foundation layer and front layer to compose the denim, wherein the front layer is tensely tautened in intermittence with a tensile force greater than a tensile force on the foundation layer to make the foundation layer have random knots; and respectively washing two faces of the denim to remove the residual dyestuff. By knitting the yarn to compose the denim, the denim has even twilling patterns and excellent softness. By tensely tautening the front layer in intermittence during the knitting process, multiple random knots are generated on the foundation layer. Therefore, the achieved denim possesses multiple good features of softness, random knotting, and even twilling patterns.

4 Claims, No Drawings

METHOD FOR KNITTING DENIM

BACKGROUND OF THE INVENTION

1. Field of the Invention

The present invention relates to a method of manufacturing denim, and more particularly a method for knitting denim that has random knots and even twilling patterns in appearance.

2. Description of Related Art

Denim (so-called jean) is conventionally made by a tatting method to create random knotting feature on surfaces and special color-fading feature, wherein both features make the denim garments popular all over the world. Moreover, the denim has excellent abrasion durability and is especially popular among laboring workers.

However, the tatted denim is not as soft in texture as other cloth made by a knitting method. Therefore, applications of the denim in fashion design are limited because of the rigidity of the tatted denim. Some manufacturers have applied the knitting method to the denim to make it soft. Although the knitting method improves the softness of the denim, the conventional knitting method can not create the special knotting and color-fading features on the denim. Additionally, the denim made by the knitting method is deformed and biased and uneven in color dispersion so that the denim does not have fine appearance to meet the denim look. Moreover, the denim made by the knitting method has poor fastness of dyeing (Indigo) and fades badly. Therefore, the knitted denim is not popular in the textile industry.

The present invention has arisen to mitigate and/or obviate the disadvantages of the conventional methods for manufacturing denim.

SUMMARY OF THE INVENTION

The main objective of the present invention is to provide a method for knitting denim, wherein the knitted denim has random knots and even twilling patterns in appearance the same as tatted denim.

To achieve the above objective, the method for knitting denim comprises acts of: dyeing yarn with a dyestuff to obtain dyed-yarn; knitting the dyed-yarn into a foundation layer and front layer to compose the denim, wherein the front layer is tensely tautened in intermittence with a tensile force greater than a tensile force on the foundation layer to make the foundation layer have random knots; and respectively washing two faces of the denim to remove the residual dyestuff.

By knitting the yarn to compose the denim, the denim has even twilling patterns and excellent softness. By tensely tautening the front layer in intermittence during the knitting process, multiple random knots are generated on the foundation layer. Therefore, the achieved denim possesses softness equal to that of knitted denim, and random knotting and even twilling patterns equal to those of the tatting denim.]

Further benefits and advantages of the present invention will become apparent after a careful reading of the detailed description.

DETAILED DESCRIPTION OF THE INVENTION

A method of knitting denim in accordance with the present invention comprises acts of:

dyeing yarn with a dyestuff to obtain dyed-yarn;

knitting a foundation layer and front layer with the dyed-yarn to compose denim, wherein the front layer is tensely tautened in intermittence with a tensile force greater than a tensile force on the foundation layer to make the foundation layer have random knots; and respectively washing two faces of the denim to remove the residual dyestuff.

Further description about the method for manufacturing the denim is illustrated as the following:

Conventional methods for denim dyeing are rope dyeing, piece dyeing and cheese dyeing. In the dyeing act of the present invention, knitting yarn is dyed with a dyestuff (mostly Indigo) by rope dyeing to improve the fastness and dispersion of the dyestuff. The rope dyeing is to sop the knitting yarn into a tank for sopping dyestuff and then to press the dyed knitting yarn between paired rollers to remove surplus dyestuff. The knitting yarn is repeatedly sopped and pressed until the dyestuff is fastened on the knitting yarn. Preferably, each strand of knitting yarn is dyed around surfaces and has a white core. The strands of dyed knitting yarn are evenly dispersed to bottle bobbins so as to eliminate transversal discreteness in color when the dyed knitting yarn is used on a circular weft knitting machine.

In the knitting act of the present invention, the dyed yarn is knitted on the circular weft knitting machine and used to perform a dual-plied denim including a foundation layer and a front layer, wherein each layer has an even twilling pattern performed by knitting. The foundation layer is loosely knitted with variable tensile force in intermittence by adjusting the (circular weft) knitting machine. Then, the front layer is densely constructed with high tensile force by adjusting the (circular weft) knitting machine to a high-density program. After tightening, the front layer, the foundation layer is shrunk to create multiple knots on the foundation layer. Thereby, the denim is obtained. When the denim is used, the foundation layer having multiple knots serves as an outer surface to reveal the random knots in appearance. Correspondingly, the front layer serves as an inner surface.

Conventional method of washing the denim is to wash only the outer face of the denim to remove residual dyestuff. In the washing act of the present invention, the denim is washed at both inner and outer faces respectively in different processes to completely remove the residual dyestuff and other sizing from the denim.

The following table shows several preferred embodiments of the tensile force applied to the foundation layer and the front layer of the denim during the knitting act.

| | Front layer | | Foundation layer |
|---|---|---|---|
| A | 1st needle is 35 g of tensile force and 2nd needle is 30 g of tensile force in alternative | A | First 5 needles are 12 g of tensile force and next 4 needles are 10 g of tensile force in turn |
| B | 1st needle is 30 g of tensile force and next 2 needles are 25 g of tensile force in turn | B | First 4 needles are 10 g of tensile force and next 3 needles are 8 g of tensile force in turn |
| C | First 2 needles are 25 g of tensile force and next 2 needles are 20 g of tensile force in turn | C | First 3 needles are 8 g of tensile force and next 2 needles are 6 g of tensile force in turn |
| D | First 2 needles are 20 g of tensile force and next 3 needles are 15 g of tensile force in turn | D | First 2 needles are 6 g of tensile force and the next needle is 6 g of tensile force in turn |
| E | First 3 needles are 25 g of tensile force and next 3 needles are 30 g of tensile force in turn | E | 1st needle is 6 g of tensile force and 2nd needle is 12 g of tensile force in turn |

With regard to the washing act of the present invention, a preferred embodiment of washing procedures is shown in the following table.

| Step | Item | Detail conditions |
|---|---|---|
| 1 | Sopping inner surface with hot water | Sopping the inner surface with 70° C. hot water for 15 min |
| 2 | Desizing the inner surface | Rolling the inner surface in 70° C. hot water and desizing agent for 15 min |
| 3 | Cleaning the inner surface with bio-enzyme and pumice | Rolling the inner surface in a mixture of 55° C. warm water, glacial acetic acid, bio-enzyme, and volcano pumice for 30 min |
| 4 | Neutralizing the inner surface | Rolling the inner surface in a mixture of cold water at room temperature, soda ash and volcano pumice for 10 min |
| 5 | Washing the inner surface with water | Rolling the inner surface in a mixture of cold water at room temperature and soapgen for 10 min |
| 6 | Drying the inner surface | Dehydrating the denim by rotation of 3500 rpm and drying the inner surface at 80° C. for 30 min |
| 7 | Turning over | Manually turning the denim over |
| 8 | Sopping outer surface with hot water | Sopping the outer surface with 70° C. hot water for 15 min |
| 9 | Cleaning the outer surface with bio-enzyme and pumice | Rolling the outer surface in a mixture of 55° C. warm water, glacial acetic acid, bio-enzyme, and artificial pumice for 30 min |
| 10 | Neutralizing the outer surface | Rolling the outer surface in a mixture of cold water at room temperature, soda ash, and artificial pumice for 10 min |
| 11 | Washing the outer surface with water | Rolling the outer surface in a mixture of cold water at room temperature and soapgen for 10 min |
| 12 | Softening the outer surface | Rolling the outer surface in a mixture of cold water at room temperature and softener for 10 min |
| 13 | Drying the outer surface | Dehydrating the denim by rotation of 6000 rpm and drying the outer surface at 80° C. for 50 min |
| 14 | Cooling the outer surface | Rolling the outer surface at room temperature for 50 min to cool the denim |

Unlike the denim made by conventional methods having to be cut in a longitudinal direction, the denim made by the method of the present invention has to be cut in transversal direction. The reason for this difference is that the knitting in the present invention is performed in a circular spiral configuration on the circular weft knitting machine and knitted yarn in the denim has bias restitution force itself. If the denim in the present invention is cut longitudinally, each piece will bias obviously and the twilling patterns will suffer worsening deformation as the pieces lengthen.

By knitting the yarn to compose the denim, the denim has even twill patterns and excellent softness. By tensely tautening the front layer in intermittence during the knitting process, multiple random knots are generated on the foundation layer. Therefore, the achieved denim possesses multiple good features of softness, random knotting, and twilling patterns, i.e., the achieved denim contains all good features of both the knitting method and tatting method.

Although the invention has been explained in relation to its preferred embodiment, it is to be understood that many other possible modifications and variations can be made without departing from the spirit and scope of the invention as hereinafter claimed.

What is claimed is:

1. A method of knitting denim, the method comprising the steps of:

dyeing yarn with a dyestuff to obtain dyed-yarn;

knitting the dyed-yarn into a foundation layer and front layer to compose denim, wherein the front layer is tensely tautened in intermittence with a tensile force greater than a tensile force on the foundation layer to make the foundation layer have random knots; and washing respectively two faces of the denim to remove residual dyestuff, wherein the front layer serves as an inner surface of the denim and the foundation layer serves as an outer surface;

procedures of the washing act comprise:

(a) sopping the inner surface with hot water;

(b) desizing the inner surface;

(c) cleaning the inner surface with bio-enzyme and pumcie;

(d) neutralizing the inner surface;

(e) washing the inner surface with water; and (f) drying the inner surface;

(g) sopping the outer surface with hot water;

(h) cleaning the outer surface with bio-enzyme and pumice;

(i) neutralizing the outer surface;

(j) washing the outer surface with water;

(k) softening the outer surface;

(l) drying the outer surface; and (m) cooling the outer surface; and conditions of the washing procedures correspondingly are:

(a) sopping the inner surface with 70° C. hot water for 15 min;

(b) rolling the inner surface in 70° C. hot water and desizing agent for 15 min;

(c) rolling the inner surface in a mixture of 55° C. warm water, glacial acetic acid, bio-enzyme, and volcano pumice for 30 min;

(d) rolling the inner surface in a mixture of cold water at room temperature, soda ash and volcano pumice for 10 min;

(e) rolling the inner surface in cold water at room temperature;

(f) dehydrating the denim by rotation of 3500 rpm and drying the inner surface at 80° C. for 30 min;

(g) sopping the outer surface with 70° C. hot water for 15 min;

(h) rolling the outer surface in a mixture of 55° C. warm water, glacial acetic acid, bio-enzyme, and artificial pumice for 30 min;

(i) rolling the outer surface in a mixture of cold water at room temperature, soda ash, and artificial pumice for 10 min;

(j) rolling the outer surface in cold water at room temperature;

(k) rolling the outer surface in a mixture of cold water at room temperature and softener for 10 min;

(l) dehydrating the denim by rotation of 6000 rpm and drying the outer surface at 80° C. for 50 min; and (m) rolling the outer surface at room temperature for 50 min to cool the denim.

2. The method as claimed in claim 1, wherein the dyed-yarn is knitted in a circular spiral configuration.

3. The method as claimed in claim 1, wherein the knitting yarn is dyed by rope dyeing that comprises the step of:

dipping the knitting yarn into a tank for sopping the dyestuff;

pressing the dyed knitting yarn between paired rollers to remove surplus dyestuff; and repeating the dipping act and pressing act until the dyestuff is fastened on the knitting yarn.

4. The method as claimed in claim 1, wherein the act of knitting is performed so that the foundation layer is loosely knitted with variable tensile force in intermittence; and the front layer is tensely knitted with variable tensile force in intermittence.

* * * * *